United States Patent [19]

Good

[11] 4,217,996

[45] Aug. 19, 1980

[54] MATERIAL STORAGE AND FEEDING DEVICE

[76] Inventor: Lewis D. Good, 7579 - 100th St., SE., Caledonia, Mich. 49316

[21] Appl. No.: 946,390

[22] Filed: Sep. 27, 1978

[51] Int. Cl.[2] ..... B01F 7/04

[52] U.S. Cl. ..... 222/404; 366/287; 414/305

[58] Field of Search ..... 366/287, 288; 222/226, 222/236, 404, 410, 196; 414/305, 307, 310, 315

[56] References Cited

U.S. PATENT DOCUMENTS

| | | | |
|---|---|---|---|
| 1,135,348 | 4/1915 | Boshell . | |
| 1,861,135 | 5/1932 | Riley . | |
| 2,297,890 | 10/1942 | Huffschmidt . | |
| 2,831,663 | 4/1958 | Nauta | 366/287 |
| 2,840,357 | 6/1958 | Nauta | 366/287 X |
| 3,339,759 | 9/1967 | Wellons | 222/404 X |
| 4,072,297 | 2/1978 | Vries | 366/287 |

FOREIGN PATENT DOCUMENTS

| | | | |
|---|---|---|---|
| 542844 | 12/1955 | Belgium | 366/287 |
| 470196 | 5/1969 | Switzerland | 366/287 |

*Primary Examiner*—David A. Scherbel
*Attorney, Agent, or Firm*—Price, Heneveld, Huizenga & Cooper

[57] ABSTRACT

A material feeding device for storing and feeding material and especially granulated material such as sawdust, wood chips, nut shells, or corn cobs at a controlled rate. The device includes a hopper which is preferably tapered toward its outlet end and a drive assembly which revolves a radial rotor arm carrying a rotating agitator toward the material at a controlled rate for loosening of the material. The rotatable agitator has outward projections and extends through the hopper. Such revolution and rotation of the agitator prepares the material by release by loosening and moving the material in the hopper upwardly allowing it to fall freely downwardly under gravity through the hopper outlet. If desired, the direction of rotation of the agitator may be reversed to force the material downwardly. Revolution and rotation of the agitator may also be controlled with an adjustable brake assembly. The agitator may be heated to loosen it if the material to be fed is frozen.

23 Claims, 8 Drawing Figures

MATERIAL STORAGE AND FEEDING DEVICE

BACKGROUND OF THE INVENTION

This invention relates to structures for storing and feeding of various materials and, more particularly, to a hopper device for storing and feeding coarse and/or granulated material such as sawdust, wood chips, nut shells, corn cobs and the like at a controlled rate without packing or clogging and without constant manual attention.

It is common to burn granulated, otherwise waste material such as sawdust, wood chips, nut shells, corn cobs and the like for various energy producing functions such as heating. With a furnance or incinerator which burns such materials, it is necessary to store and feed such materials at a controlled rate so that proper combustion will continue. In the past, several problems have occurred which make the storing and feeding of such materials difficult, time-consuming and/or expensive.

First, the nature of the materials to be stored and fed as well as the requirements for such storage and feeding, often cause congestion at the outlet of the storing or feeding device. More specifically, with irregularly shaped, granulated and/or coarse materials such as nut shells, wood chips or corn cobs, clogging and jamming often occurs at the restricted outlet end of a hopper or other storage container. This has typically required the nearly constant attention of an operator which increases both the cost and difficulty in the feeding operation.

A second problem is that of continued, controlled feeding in outside areas in subfreezing temperatures. Since many incinerators or furnaces are fed from material stored outside, a common occurrence is the freezing in the storage hopper of moist or wet materials such as green or fresh sawdust, wood chips or the like. Prior known storage and feeding devices which may have included large blades or a stationary auger within a hopper were difficult or impossible to operate with frozen materials in the hopper since the blade or auger could not be moved to produce the desired, controlled feeding.

Other problems encountered with the use of storage and feeding devices for furnaces, boilers and the like included an inability to obtain access to the operative parts of a storage and feeding mechanism. Also, proper control over the desired feed rate from the storage and feeding device was often difficult.

The present invention was devised in recognition of and as a solution for the above and other problems encountered in the storage and direct or indirect feeding of otherwise waste materials intended for burning in furnaces, boilers and the like.

SUMMARY OF THE INVENTION

Accordingly, the present invention provides a material storage and feeding device which allows the continuous, controlled feeding of coarse and/or granulated, otherwise waste materials such as sawdust, nut shells, wood chips, corn cobs and the like over a predetermined period of time. The invention utilizes a rotatable agitator extending through a storage hopper which is rotated to bite into and loosen the stored materials for release in a free fall through the outlet end of the hopper at a controlled rate. Packing and clogging of material at the outlet end is avoided. The device automatically revolves a rotor arm carrying the agitator toward the stored material. When the rotor arm encounters resistance to its own revolution, the agitator is rotated on its own axis causing it to bite into and loosen the material. Continued rotation of the agitator during revolution of the rotor arm continues to release the material at a controlled rate. When the hopper is empty, the rotor arm revolves without rotation of the agitator. The mechanism provides for durable, maintenance-free operation, but allows access to the mechanism if desired. In addition, the structure allows for heating of the mechanism for use in cold or freezing temperatures while a brake assembly is included for controlling the rate of revolution of the arm carrying the rotatable agitator.

In one form, the invention is a material feeding hopper for providing a controlled flow of material such as sawdust, wood chips, corn cobs or the like wherein the hopper includes an inlet and outlet ends, and side walls connecting the ends. A rigid, material agitator having an axis and extending from adjacent the hopper inlet to the hopper outlet is provided along with support means for rotatably supporting the agitator. The support means include means for revolving the agitator within the hopper about an axis spaced from the agitator axis and rotation means for rotating the agitator about its axis. The support means provide combined revolution and rotation of the agitator which thus engages and loosens material within the hopper and maintains a controlled outflow of material through the hopper outlet end.

In other aspects, the agitator is an elongated, rigid tube having projections on its exterior which are preferably angled fins or a helical rib enabling material within the hopper to be driven upwardly or downwardly depending on the direction in which the agitator is rotated. The hollow space within the agitator allows it to be heated with a torch or the like to sufficiently loosen it within the material in subfreezing temperatures. A brake assembly on the drive means for rotating the agitator enables the resistance to rotation of the agitator to be governed and controlled as desired so that revolution of the rotor arm carrying the agitator toward the material within the hopper, and thus the rate at which the agitator bites into and loosens material, is suitably controlled.

The present invention has numerous advantages over prior known storage and feeding devices. Feeding of irregularly shaped, granulated and/or coarse materials is maintained on a continuous, positive control basis. Constant attention to feeding is eliminated even for materials which are otherwise extremely difficult to feed. The device can be used in exterior locations even in subfreezing temperatures. The agitator may be rotated in either direction to pull the stored materials in the hopper upwardly and allow them to fall freely downwardly and out of the hopper or drive the materials downwardly to further control the rate of feed. Loosening of the material within the hopper continues automatically by means of the agitator support and drive mechanisms.

These and other objects, advantages, purposes and features of the invention will become more apparent from a study of the following description taken in conjunction with the drawings.

DESCRIPTION OF THE PREFERRED EMBODIMENTS

Figure 1:
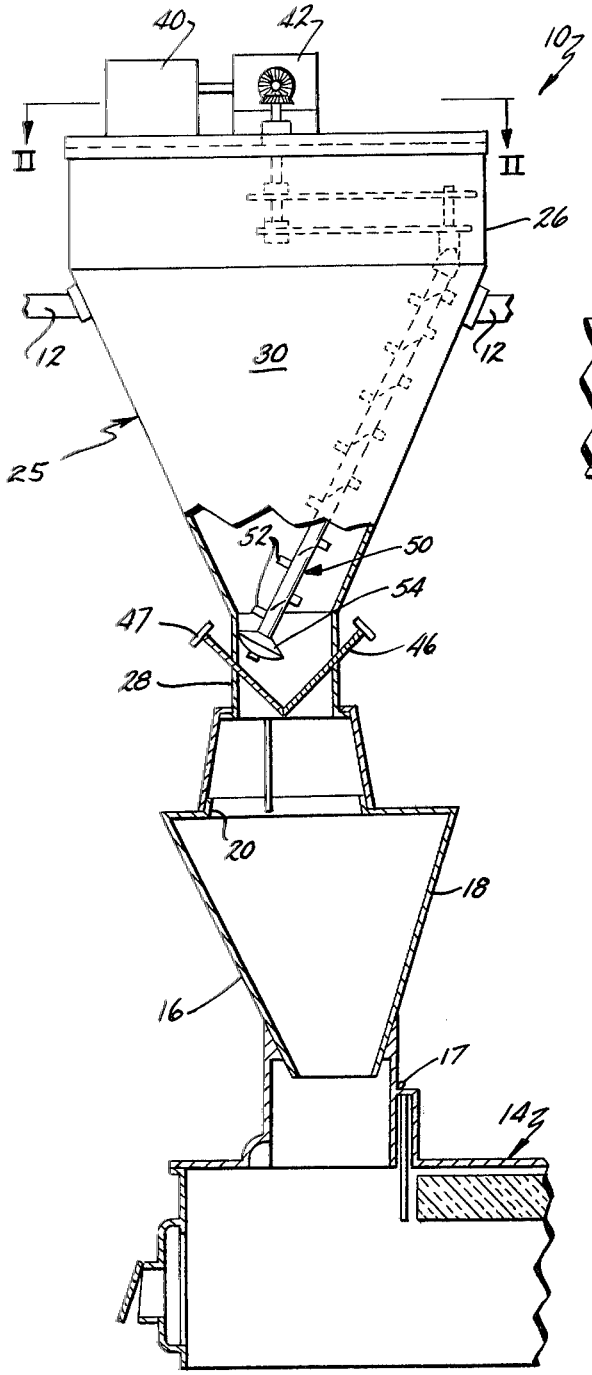
FIG. 1 is a fragmentary, side elevation of the material feeding device of the present invention supported over the inlet of a conventional furnace or incinerator, the feeding device and incinerator or furnace being shown partially in section.
Figure 2:
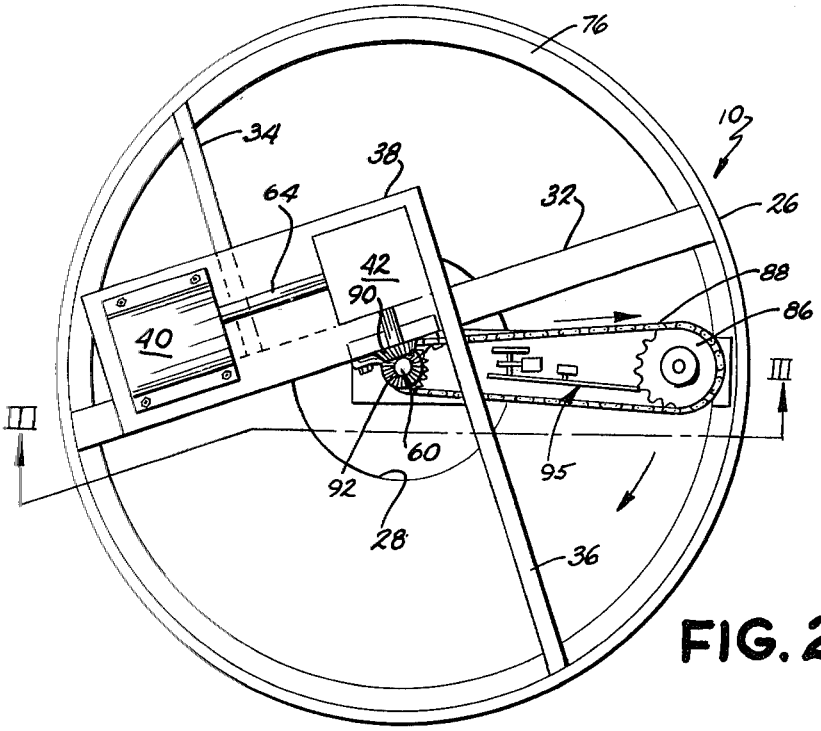
FIG. 2 is a plan view of the material feeding device shown in FIG. 1.
Figures 3, 3A:
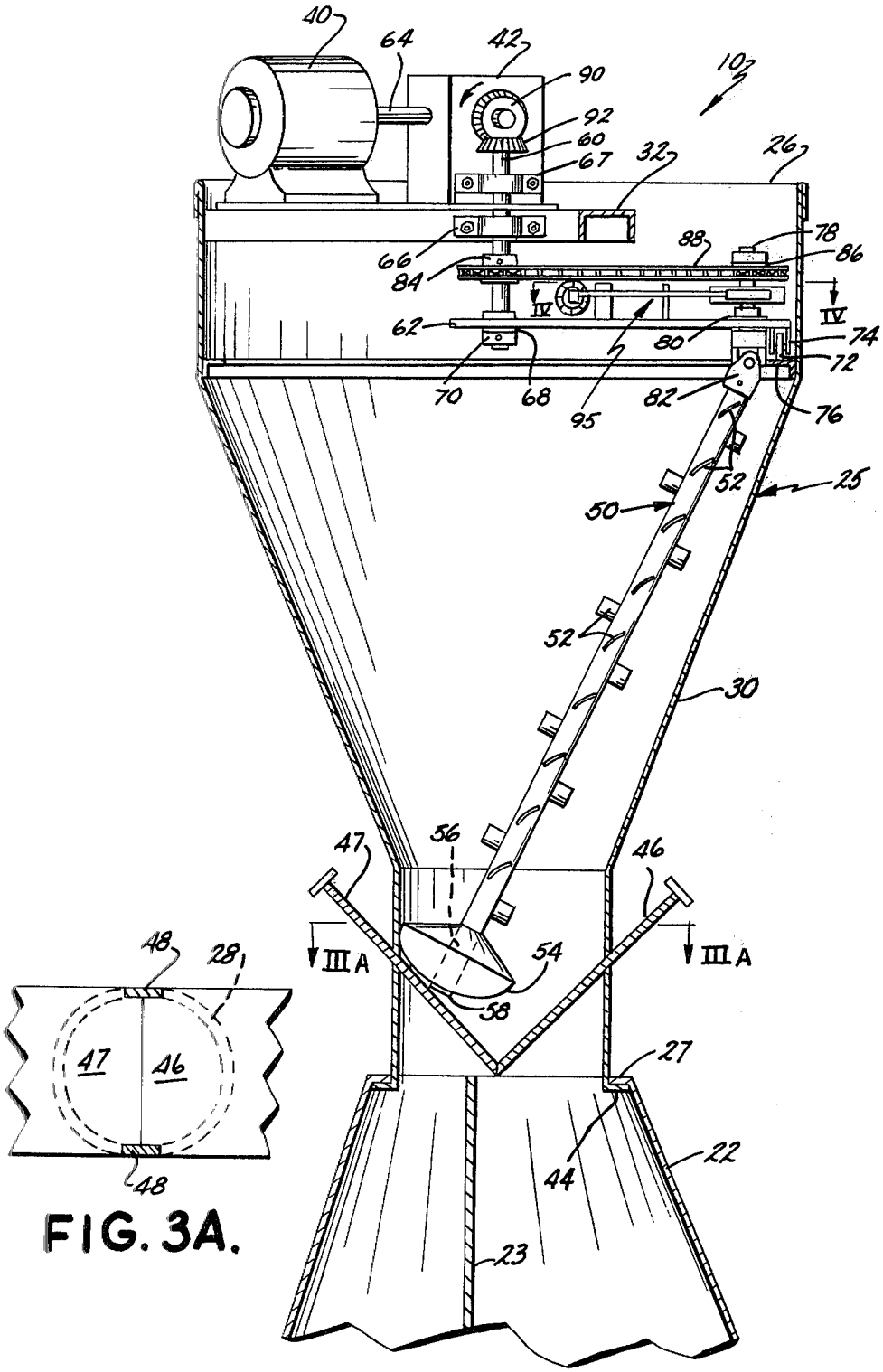
FIG. 3 is a sectional, side elevation of the material feeding device taken along line III—III of FIG. 2 further illustrating the drive mechanism and agitator.
FIG. 3A is a plan view of the control gates at the hopper outlet taken along plane IIIA—IIIA of FIG. 3.

Referring now to the drawings in greater detail, FIGS. 1-3 illustrate a storage and feeding hopper 10 in accordance with the present invention. As shown in FIG. 1, hopper 10 is supported by support beams or other structure 12 above a furnace or incinerator 14 having an inlet end 16 including a tapered, covered fuel receptacle 18. Receptacle 18 includes an upstanding neck flange 20 over which is fitted the lower, slidable duct or housing 22 at the outlet end of hopper 10 so that material loosened and released from hopper 10 flows continuously into receptacle 18. The storage and feed hopper 10 therefore provides a controlled flow of fuel materials such as sawdust, wood chips, nut shells, corn cobs or the like into receptacle 18 which in turn directs them into inlet 16 of the furnace. Alternately, with certain materials, receptacle 18 could be eliminated so that hopper 10 feeds directly into inlet 16, if desired.

As is best seen in FIGS. 1 and 3, the storage and feed mechanism 10 includes a generally conical hopper 25 having an upper, right, circular, cylindrical inlet portion 26 and a lower, right, circular, cylindrical outlet portion 28 which is coaxial with inlet portion 26. Inlet and outlet portions 26, 28 are connected by a continuous, conical or tapering side wall 30. Depending on the size and type of material to be stored and fed from hopper 25, the size and thickness of the hopper inlet, outlet and side wall portions can be changed as desired.

Mounted within and adjacent to the end of inlet portion 26 is a support structure for the rotatable actuator 50 and rotor arm 62 which provide the ability to feed materials from the hopper at a controlled rate. As shown in FIG. 2, the support structure includes a main cross-beam 32 in the form of a steel channel or the like welded within the inlet portion 26 immediately adjacent the central axis of that cylindrical portion. A pair of support beams or braces 34, 36 extend perpendicularly from beam 32 to opposite sides of the interior of the inlet portion. Secured atop beams 32, 34 by welding or the like is a steel platform 38 which provides an area for mounting electric motor 40 and gear reducer 42 which provides the motive power for rotating the agitator and its supporting rotor arm within the hopper. An outwardly extending support flange 44 is provided at the lower end of cylindrical outlet portion 28 to suspend the truncated, conical housing 22 which forms the connection between the lower end of the hopper 10 and any receptacle 18 for a furnace or incinerator as mentioned above. Housing 22 is formed in one continuous piece with a seam 23 (FIG. 3) extending downwardly therealong on one portion. It includes an upper flange 27 which rests on the lower flange 44 as shown in FIG. 3.

Also included in the cylindrical outlet portion 28 are downwardly angled, slidable plates 46, 47 which provide a control or shut off gate for limiting the outflow of material from hopper 25. Plates 46, 47 are slidably mounted in vertically angled slots which extend partially through cylindrical outlet 28 as shown in FIG. 3A. Plates 46, 47 are notched to extend around posts 48 at the opposite sides of outlet 28. Thus, plates 46, 47 allow substantially the entire outlet to be closed when in the position shown in FIG. 3A but may be slid outwardly of the outlet to allow an outflow of material. Plates 46, 47 may be removed completely and duct 22 slid upwardly away from neck flange 20 to allow pivotal movement of receptacle 18 about pivot point 17 to provide direct access to the interior of the furnace or incinerator 14.

Figure 5:
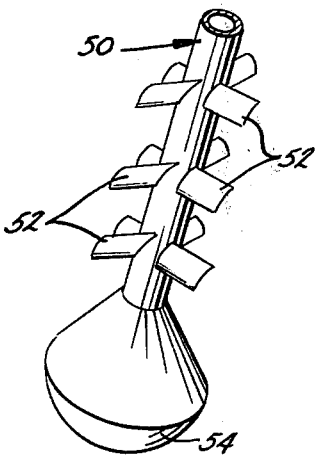
FIG. 5 is a fragmentary, perspective view of the lower end of the agitator.

As shown in FIGS. 1, 3 and 5, the principal element for biting into and loosening materials contained within the hopper to control their feeding from the hopper is an elongated, rigid, tubular agitator 50. Agitator 50 is formed preferably from right, circular, cylindrical, steel tubing (FIG. 5) and is sufficiently long to extend from the cylindrical inlet portion 26 into the cylindrical outlet portion 28 above sliding plate 46. Extension into outlet 28 prevents clogging of material at the restricted hopper outlet. At spaced positions along the length of agitator 50 are biting projections or angled fins 52 which may be secured in a screw-like pattern so that rotation of the agitator 50 causes the fins 52 to move the materials in the hopper upwardly or downwardly depending on the direction of rotation of the agitator. Fins 52 may themselves be curved to facilitate such action. At the lower end of agitator 50 is a tapered, circular, spacing member 54 having a circular passageway or bore 56 located centrally therein and coaxial with the interior of tubular agitator 50. Spacer 54 is welded or otherwise secured to the lower end of agitator 50 and a threaded plug 58 or the like is inserted in the passageway 56 to close its lower end and prevent the entry of the materials in the hopper therein. The top side surfaces of circular spacer 54 are tapered to prevent collection of materials in the hoppers thereon to facilitate flow over the circular spacer member. Inasmuch as agitator 50 is pivotally mounted at the upper end of the hopper, as will be more fully described below, spacer 54 spaces the agitator and its projecting fins 52 away from the sides of the hopper to prevent damage to either the agitator or the hopper walls. Further, plug closure 58 in passageway 56 may be removed in cold or subfreezing temperatures to allow access to the interior of the tube through slidable duct 22 and plate 46 for heating with a propane torch or the like. Such heating increases the temperature of the agitator sufficiently to thaw the materials surrounding the agitator allowing its rotation and further loosening of materials even in such cold temperatures. Preferably, agitator 50 is formed from four inch diameter steel tubing. Such tubing provides sufficient rigidity and strength for adequate loosening and feeding of the types of granulated, combustible fuel materials mentioned herein.

Figure 5A:
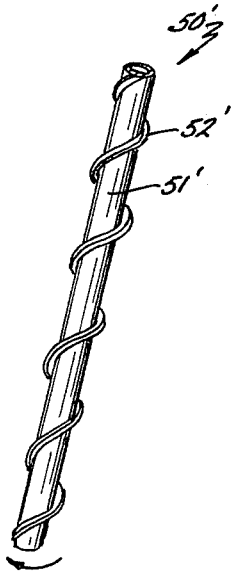
FIG. 5A is a fragmentary, perspective view of a modified form of the agitator.

Alternately, agitator 50' including a continuous, helical rib 52' welded or otherwise secured to the cylindrical surface of a rigid tube 51' may be used. Rib 52' is preferably a metallic, rigid rod of square or rectangular cross-sectional shape bent around and attached to the tube. The continuous, sharp edges of the rib bite into the materials within hopper 10 as do fins or projections 52 in agitator 50. With agitator 50', no spacer 54 need be used since rib 52' would not damage the hopper sides. Agitator 50' would, however, project into outlet 28 as does agitator 50. The helical rib 52' lifts materials, allowing them to fall freely through the outlet, when rotated in the direction of the arrow in FIG. 5A, and drives the materials downwardly when rotated opposite to that direction.

As shown in FIGS. 2 and 3, the drive assembly for rotating agitator 50 on its axis includes a reversible electric motor 40, gear-type speed reducer 42, rotatable support shaft 60, and radially directed rotor arm 62. Motor 40 is connected to gear speed reducer 42 by a direct shaft 64 while support shaft 60 is rotatably secured in a fixed vertical position, coaxial with the axis of hopper 25, by means of a pair of bearing pillow blocks 66 secured one to the side of main beam 32 and one above that beam on a support 67 adjacent the axis of the hopper. Rotor arm 62 is secured at the lower end of support shaft 60 on bearings 68 within an aperture in the arm. Bearings 68 are retained on the lower end of the shaft by a collar 70 including a set screw or the like. Shaft 60 is therefore rotatable within rotor arm 62 until resistance to rotation of agitator 50 is met.

At the outer end of rotor arm 62 is a support wheel or castor 72 rotatably mounted in supports 74 and supported by a rim or flange 76 which extends continuously around the interior of cylindrical inlet portion 26 of hopper 25 (FIGS. 2 and 3). Rotor arm 62 is therefore fully supported for swinging revolution about shaft 60 which corresponds to the axis of hopper 25.

At the outer end of rotor arm 62 immediately inside wheel or castor 72 is rotatably mounted a second support shaft 78 which is parallel to support shaft 60. Shaft 78 is mounted in suitable bearings 80 in another aperture in arm 62 and has its lower end projecting through and below rotor arm 62. On this end of shaft 78 is mounted a universal joint 82 which in turn is secured to agitator 50 or 50'. Hence, agitator 50 or 50' will be rotated on its own axis and spaced from walls 30 of hopper 25 by spacer 54 regardless of the circumferential position of rotor arm 62 within the hopper. The universal joint facilitates the downwardly angled position of agitator 50 or 50' which insures loosening of material over the full height and nearly the full width of the hopper.

Rotation of agitator 50 or 50' is accomplished by a drive chain extending from shaft 60 to shaft 78. The chain drive assembly includes a chain sprocket 84 of an appropriate desired size secured intermediate pillow block 66 and bearings 68 on shaft 60. A second gear sprocket 86, having a size twice that of sprocket 84, is secured adjacent the upper end of shaft 78. A drive chain 88 is positioned around sprockets 84, 86. Thus, when rotational motion from bevel gear 90 on gear speed reducer 42 transfers rotational motion to bevel gear 92 at the top of support shaft 60, that rotational motion is automatically transferred via the chain drive assembly 84, 86, 88 to shaft 78 which in turn transfers it to universal joint 82 and agitator 50.

Figure 4:
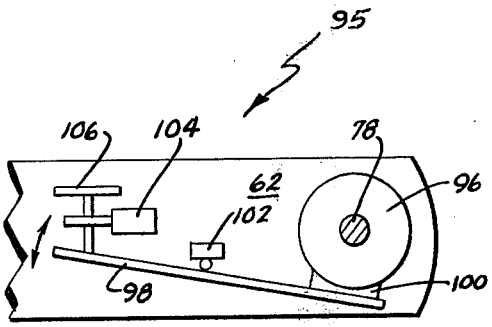
FIG. 4 is a fragmentary, sectional, plan view of the brake assembly included in the drive mechanism for the invention.

Mounted on the top surface of rotor arm 62 below the chain assembly is a brake assembly for adjusting the resistance to rotation of shaft 78, and thus universal joint 82 and agitator 50 or 50', to cause controlled revolution of rotor arm 62 as desired. As is best seen in FIG. 4, brake assembly 95 includes a brake disc 96 fixedly secured to shaft 78 intermediate sprocket 86 and bearings 80. A brake arm 98, having an appropriately curved brake shoe 100 for mating with the circumferential surface of disc 96, is pivotally secured on an upstanding support 102 adjacent the disc. A brake adjusting screw 106 is threadedly secured through an extending flange of a second, upstanding support 104. The end of screw 106 engages the end of brake arm 98 which is remote from disc 96 and shoe 100 on the opposite side of pivot 102. As shown by the arrow in FIG. 4, axial movement of the threaded screw 106 pivots brake arm 98 about pivot 102 to increase or decrease the braking pressure exerted by shoe 100 on the edge of disc 96. Accordingly, frictional resistance to rotation of shaft 78 is increased or decreased depending on axial movement of screw 106.

Operation of the storage and feed hopper 10 will now be understood. Once material such as sawdust, wood chips, nut shells, corn cobs or the like have been poured into hopper 25 through its open, inlet end 26, the material may be stored until feeding at a controlled rate through outlet 28 as desired. When such feeding is desired, electric motor 40, which is connected to an appropriate source of electrical energy may be switched on and operated to cause rotation of shaft 64 and thus bevel gear 90 via speed reducer 42. Bevel gear 90 transfers rotational motion to bevel gear 92 and support shaft 60. Shaft 60 transfers rotational motion to sprocket 84 and thus shaft 78 and sprocket 86 via chain 88. If no material was present in the hopper, the rotor arm 62 would revolve at the speed of shaft 60 without rotation of agitator 50 or 50'. The resistance of the material to be fed, however, acts on agitator 50 or 50' to resist revolution of rotor arm 62. With such resistance, the rotational motion of shaft 78 is transferred to and causes rotation of agitator 50 or 50' on its own axis within the hopper by means of the universal joint regardless of the radial position of the rotor arm 62. The revolution and rotation thus occurs in combination when material is present. The rotation of agitator 50 causes the projections or fins 52 to bite into and loosen the material within the hopper along virtually the entire height of the hopper below the rotor arm. As material is loosened, it drops freely via gravity to the outlet end 28 where its outflow is further controlled by the sliding plates 46, 47 which may be adjusted as desired. If more positive feeding is desired, rotation of the motor 40, and thus ultimately agitator 50, can be selected to rotate agitator 50 or 50' counterclockwise (in FIG. 3) such that the fins 52 force the materials downwardly. Alternately, the motor may be operated in the reverse direction to rotate agitator 50 or 50' clockwise (in. FIG. 3), causing a lifting of the material in the hopper, allowing it to drop by gravity into the outlet end and avoid undue pressure on the sliding gate or plate 46.

At the same time, the agitator 50 is biting into the material, such action resists rotation of the agitator and thus shaft 78. Such resistance to rotation is transferred via shaft 78 to chain 88 so that revolution of rotor arm 62 about axis 60 is further induced. It will be understood that if shaft 78 were fixed in rotor arm 62, rotation of shaft 60 would lock chain 88 in a fixed position causing rotor arm 62 to revolve at the identical, rotational speed of shaft 60. However, when some rotation of shaft 78 occurs, chain 88 is not completely fixed and rotor arm 62 will revolve about shaft 60 at a speed lesser than the rotational speed of that shaft. Accordingly, the greater the resistance to rotation of agitator 50, the faster rotor arm 62 will revolve about shaft 60. Thus, resistance of the material within the hopper urges arm 62 toward the material while agitator 50 or 50' rotates causing further biting and loosening of the material. It will be understood that the actual direction of revolution of arm 62 depends on the direction of movement of chain 88 and thus, agitator 50.

The above resistance to rotation of agitator 50 may be controlled by brake assembly 95 to obtain the desired rate of revolution of rotor arm 62 as described above. Counterclockwise movement of brake arm 98 (as shown in FIG. 4) will increase the braking pressure exerted by shoe 100 on disc 98 thereby increasing resistance to rotation or shaft 78 and increasing the speed or revolution of the rotor arm. Conversely, clockwise movement of brake arm 98 will reduce the braking pressure, the resistance to rotation on shaft 78, and thus, the speed of revolution of rotor arm 62. Accordingly, the speed of revolution of the rotor arm, and thus the loosening action of the agitator, can be adjustably controlled with brake assembly 95 mounted on the rotor arm.

Figure 6:
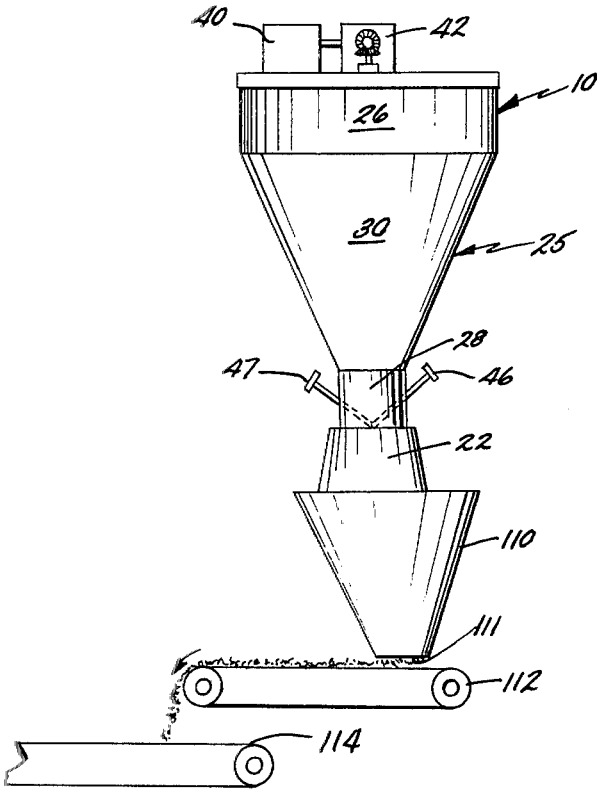
FIG. 6 is a side elevation of the material feeding device mounted in cooperation with a series of conveyors for further controlled feeding of material.

As shown in FIG. 6, an alternate mounting of storage and feed hopper 10 of the present invention is shown. In this form, the storage and feed hopper is supported over a tapered or conical receptacle 110 having an outlet 111 which feeds material onto a first belt-type, endless conveyor 112. Conveyor 112 is driven by an appropriate drive assembly (not shown) at a controlled rate of speed to feed the material from receptacle 110 and hopper 10 to a second conveyor 114 of a similar nature. This overall structure can be used to feed combustible materials and other materials fed at a controlled rate from hopper 10 to a furnace or incinerator at a location remote from the hopper by means of the series of conveyors 112, 114 and the like. Each of the conveyors can be operated at a speed as desired to further control the rate of delivery of the material fed from hopper 10 and receptacle 110. Accordingly, the present storage and feed mechanism can be combined with other devices for using or transporting the material fed from the hopper as desired.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. A material feeding mechanism comprising a hopper having an axis, an inlet end, an outlet end smaller than said inlet end, and sides tapering between said inlet and outlet ends; a rotor arm mounted adjacent said hopper inlet end for rotation generally about said hopper axis; a rigid agitator rotatably mounted on said arm and extending downwardly through said hopper to a position adjacent said hopper outlet end; drive means for rotating said arm and said agitator such that when said hopper contains material such as sawdust or the like, said arm will be revolved about said hopper axis until resistance to such revolution is met, such resistance causing said agitator to be rotated about its own axis whereby any material in said hopper will be loosened to provide a flow of material from said hopper outlet end at a controlled rate.

2. The material feeding mechanism of claim 1 wherein said agitator includes a plurality of external projections thereon for biting into and loosening material in said hopper.

3. The material feeding mechanism of claim 2 wherein said agitator also includes a circular spacing member at its bottom end for spacing said agitator away from the walls of said hopper, said projections including a series of spaced, angled fins enabling said agitator to move material up or down within said hopper depending on the direction in which said agitator is rotated.

4. The material feeding mechanism of claim 3 wherein said agitator is a hollow tube having an opening at its top, said circular spacing member including a passageway to the interior of said tube enabling heating of the interior of said tube from the bottom end with a torch or the like.

5. The material feeding mechanism of claim 1 wherein said agitator includes a helical projection extending continuously therearound for biting into and loosening material in said hopper.

6. The material feeding mechanism of claim 1 wherein said hopper inlet end is circular and includes support means for supporting said drive means and said rotor arm.

7. The material feeding mechanism of claim 6 wherein said hopper outlet end is circular and includes a movable closure therein below the lower end of said agitator for controlling the outflow of material from said hopper.

8. The material feeding mechanism of claim 7 including a lower duct slidably mounted on said cylindrical hopper outlet end to provide access to said outlet end and the lower end of said agitator.

9. The material feeding mechanism of claim 6 wherein said support means include a support member extending across said inlet end, a vertical shaft mounted for rotation on said support member coaxial with said hopper axis, said rotor arm being rotatably secured at one end to said shaft, a support wheel at the outer end of said rotor arm opposite said one end, and a support rail secured around the interior of said hopper beneath said support wheel for supporting said support wheel and said outer end of said rotor arm.

10. The mechanical feeding mechanism of claim 9 wherein said drive means includes motive power means for rotating said shaft, a second shaft mounted parallel to the first of said shafts and for rotation at said outer end of said rotor arm, means for rotating said second shaft in unison with said first shaft, and universal joint means mounted on said second shaft and connected to said agitator for pivotally supporting and rotating said agitator with said second shaft.

11. The mechanical feeding mechanism of claim 10 including means for resisting rotation of said second shaft and agitator whereby relative rotation of said agitator and said rotor arm are controlled.

12. The material feeding mechanism of claim 1 including means for resisting rotation of said agitator whereby relative rotation of said agitator and rotor arm are controlled.

13. The material feeding mechanism of claim 12 wherein said agitator is connected to a shaft which is rotatably mounted on said rotor arm; said means for resisting rotation of said agitator including a brake engaging said shaft and means for controlling the force of the engagement of said brake with said shaft.

14. The material feeding mechanism of claim 1 in combination with at least one conveyor positioned below said outlet end of said hopper, said conveyor receiving the flow of material from said hopper for transportation to another location.

15. The material feeding mechanism of claim 1 including means for heating said agitator whereby loosening of the agitator in any frozen material in said hopper is facilitated.

16. A material feeding hopper for providing a controlled flow of material such as sawdust, chips, corn cobs, or the like, said hopper comprising inlet and outlet ends and side walls connecting said ends; a rigid material agitator having an axis extending from adjacent said hopper inlet end to adjacent said hopper outlet end; support means for rotatably supporting one end of said agitator adjacent said inlet end; said agitator having a free end extending into said hopper to said outlet end, at least a portion of said agitator adapted to engage said outlet end during operation of said agitator; said support means including means for revolving said agitator within said hopper about an axis spaced from said agitator axis and rotation means for rotating said agitator about its axis, said support means providing combined revolution and rotation of said agitator when material is present in said hopper for maintaining a controlled outflow of material through said hopper outlet end, said agitator being unsupported within said hopper except for rotatable support of said one end and contact between said portion of said agitator and said outlet end of said hopper.

17. The hopper of claim 16 wherein said agitator is a hollow tube including external projecting means thereon for biting into and loosening any material in said hopper.

18. The hopper of claim 16 wherein said hopper is circular, said hopper walls tapering from adjacent said inlet end to adjacent said outlet end; said agitator being rectilinear and extending downwardly through said hopper; said means for revolving said agitator including a radial rotor arm supported for rotation about the center of said circular hopper adjacent said hopper inlet end and chain drive means for rotating said agitator with respect to said rotor arm.

19. The hopper of claim 16 including means for heating said agitator whereby loosening of any frozen material in said hopper is facilitated.

20. A material feeding hopper for providing a controlled flow of material such as sawdust, chips, corn cobs, or the like, said hopper comprising inlet and outlet ends and side walls connecting said ends; a rigid material agitator having an axis extending from adjacent said hopper inlet end to adjacent said hopper outlet end; support means for rotatably supporting said agitator including means for revolving said agitator within said hopper about an axis spaced from said agitator axis and rotation means for rotating said agitator about its axis, said support means providing combined revolution and rotation of said agitator when material is present in said hopper for maintaining a controlled outflow of material through said hopper outlet end; said agitator including a hollow tube including external projecting means thereon for biting into and loosening any material in said hopper; said rotation means including a universal joint for pivotally securing said agitator, a circular spacer at the bottom of said agitator for spacing said agitator from said hopper walls, said spacer including a passageway providing access to the interior of said agitator for heating same, and closure means for closing said passageway; said projection means including a plurality of spaced, angled fins for moving any material in said hopper upwardly or downwardly depending on the direction in which said agitator is rotated.

21. A material feeding hopper for providing a controlled flow of material such as sawdust, chips, corn cobs, or the like, said hopper comprising inlet and outlet ends and side walls connecting said ends; a rigid material agitator having an axis entending from adjacent said hopper inlet end to adjacent said hopper outlet end; support means for rotatably supporting said agitator including means for revolving said agitator with said hopper about an axis spaced from said agitator axis and rotation means for rotating said agitator about its axis, said support means providing combined revolution and rotation of said agitator when material is present in said hopper for maintaining a controlled outflow of material through said hopper outlet end; said hopper being circular, said hopper walls tapering from adjacent said inlet end to adjacent said outlet end; said agitator being rectilinear and extending downwardly through said hopper; said means for revolving said agitator including a radial rotor arm supported for rotation about the center of said circular hopper adjacent said hopper inlet end and chain drive means for rotating said agitator with respect to said rotor arm; and means for resisting rotation of said agitator whereby relative rotation of said agitator and rotor arm are controlled.

22. The hopper of claim 21 wherein said agitator is connected to a shaft which is rotatably mounted on said rotor arm; said means for resisting rotation of said agitator including a brake engaging said shaft and means for controlling the force of the engagement of said brake with said shaft.

23. A material feeding hopper for providing a controlled flow of material such as sawdust, chips, corn cobs, or the like, said hopper comprising inlet and outlet ends and side walls connecting said ends; a rigid material agitator having an axis extending from adjacent said hopper inlet end to adjacent said hopper outlet end; support means for rotatably supporting said agitator including means for revolving said agitator within said hopper about an axis spaced from said agitator axis and rotation means for rotating said agitator about its axis, said support means providing combined revolution and rotation of said agitator when material is present in said hopper for maintaining a controlled outflow of material through said hopper outlet end; and means for resisting rotation of said agitator whereby relative rotation of said agitator and rotor arm can be varied.

* * * * *

UNITED STATES PATENT AND TRADEMARK OFFICE

CERTIFICATE OF CORRECTION

PATENT NO. : 4,217,996

DATED : August 19, 1980

INVENTOR(S) : Lewis D. Good

It is certified that error appears in the above-identified patent and that said Letters Patent are hereby corrected as shown below:

Abstract, lines 10, 11
"by release" should be --for release--

Column 3, line 68:
"provides" should be --provide--

Column 4, line 52:
"hoppers" should be --hopper--

Column 5, line 46:
insert --lower-- before "end"

Column 7, line 8:
insert --rotor-- before "arm 62"

Signed and Sealed this

*Sixth* Day of *January 1981*

[SEAL]

*Attest:*

SIDNEY A. DIAMOND

*Attesting Officer*

*Commissioner of Patents and Trademarks*